US007503290B2

(12) United States Patent
Skulic

(10) Patent No.: US 7,503,290 B2
(45) Date of Patent: Mar. 17, 2009

(54) TWO-STROKE INTERNAL COMBUSTION ENGINE SUPPLIED WITH GASOLINE, DIESEL FUEL OR OTHER CONVENTIONAL FUEL

(75) Inventor: Ivan Skulic, Ivana Lenca 34, Rijeka (HR)

(73) Assignees: Ivan Skulic, Lupoglav (HR); Bruno Abenavøli, Naples (IT)

( * ) Notice: Subject to any disclaimer, the term of this patent is extended or adjusted under 35 U.S.C. 154(b) by 0 days.

(21) Appl. No.: 11/762,964

(22) Filed: Jun. 14, 2007

(65) Prior Publication Data

US 2007/0272177 A1 Nov. 29, 2007

Related U.S. Application Data

(63) Continuation of application No. PCT/IT2005/000526, filed on Sep. 15, 2005.

(51) Int. Cl.
*F01B 7/12* (2006.01)

(52) U.S. Cl. ..... 123/51 B; 123/51 BD

(58) Field of Classification Search ..... 123/51 B, 123/51 BD, 65 VB

See application file for complete search history.

(56) References Cited

U.S. PATENT DOCUMENTS

| | | | |
|---|---|---|---|
| 5,809,947 | A | 9/1998 | Thompson |
| 6,199,520 | B1 | 3/2001 | Warren |
| 6,612,273 | B1 | 9/2003 | Schumacher |

FOREIGN PATENT DOCUMENTS

| | | | |
|---|---|---|---|
| JP | 54072306 | A | 6/1979 |
| JP | 55087820 | A | 7/1980 |

*Primary Examiner*—Noah Kamen
(74) *Attorney, Agent, or Firm*—Gauthier & Connors LLP

(57) ABSTRACT

The invention concerns a two-stroke internal combustion engine supplied with gasoline, diesel, fuel, or other conventional fuel comprising a piston (2)-cylinder (1) assembly, said cylinder (1) providing exhaust ports (11), said piston (2)-cylinder (1) assembly providing a head (5) slidable within said cylinder (1) between the Top Dead Centre of the piston (2) stroke and a closure position of the exhaust ports (11), said slidable head (5) providing a transfer valve (9) for fresh air or fresh air-fuel mixture within the compression and burst chamber of the piston (2)-cylinder (1) assembly, sliding of said slidable head (5) inside the cylinder (1) being controlled by actuation means co-ordinated with the piston (2) actuation system, upward said slidable head (5) a fresh air or fresh air-fuel mixture system (13, 14) being provided for suction during the stroke of said slidable head (5) between the Top Dead Centre and the exhaust port (11) closure point.

15 Claims, 6 Drawing Sheets

TWO-STROKE INTERNAL COMBUSTION ENGINE SUPPLIED WITH GASOLINE, DIESEL FUEL OR OTHER CONVENTIONAL FUEL

PRIORITY INFORMATION

This application is a continuation of International Patent Application No. PCT/IT05/000526, filed on Sep. 15, 2005, which designated the United States and claims priority to Italian Patent Application No. RM2004A000643 filed on Dec. 29, 2004, which is incorporated by reference in its entirety herein.

BACKGROUND OF THE INVENTION

1. Field of the Invention

A two-stroke internal combustion engine supplied with gasoline, diesel, fuel, or other conventional fuel.

The invention is directed to an engine which optimizes the operation by eliminating the typical drawbacks of the two-stroke engines and of the four-stroke engines.

2. Brief Description of the Art

Inner combustion engines have been studied and developed continuously since the $19^{th}$ century in order to find engines with higher efficiency, and at the same time with the lowest pollution levels possible.

Technical features of two- and four-stroke engines are well known and thus they will not be discussed in the following.

However, it is useful to know that two-stroke engines encounter a scavenging problem, specifically the pollution caused by the ejection of oil introduced inside the combustion chamber along with fuel, as well as reliability of the engines. Four-stroke engines have problems relevant to their efficiency; however, they are preferable to the two-stroke engines due to their higher reliability.

Within the framework comprising existing engines, including Diesel engines, the Applicants suggest an innovative solution for a new and improved inner combustion engine.

The solution according to the present invention comprises an inner combustion engine that can be supplied with gasoline or diesel fuel, according to the specific design choices, thus exploiting its maximum potential, supplying not mixed fuel and with separated lubrication, as in the four-stroke engines.

The solution according to the present invention is based on optimizing the engine cycles, particularly in two-stroke engines, in such a way as to ensure the complete expulsion of the burned gases and, at the same time, a maximum filling of the cylinder with fresh air, not allowing burned gas and fresh air to mix.

Another object of the present invention is to obtain an engine having better combustion and better expansion.

SUMMARY OF THE INVENTION

An object of the present invention is a two-stroke internal combustion engine supplied with gasoline, diesel, fuel, or other conventional fuel comprising a piston-cylinder assembly. The cylinder provided exhaust ports, the piston-cylinder assembly providing a head slidable within said cylinder between the top dead centre of the piston stroke and a closure position of the exhaust ports, the slidable head provides a transfer valve for fresh air or fresh air-fuel mixture within the compression and burst chamber of the piston-cylinder assembly. Sliding of the slidable head inside the cylinder being controlled by actuation means coordinated with the piston actuation system. Upward of the slidable head is a fresh air or fresh air-fuel mixture system provided for suction during the stroke of the slidable head between the top dead centre and the exhaust port closure point. The actuation means of the slidable head provide a crankshaft connected having the output shaft by a toothed belt, with a 1:1 transmission ratio. The cam is realised with a particular thrusting curve, to act with delay on the slidable head notwithstanding the fact that it is rotating. The cam has a straight part allowing ascent of the head, by the action of springs, in a much quicker way, so that, when the piston closes the exhaust ports, the head is at the top dead centre, having already carried out the transfer action of the fresh mixture through the transfer valve.

Preferably, according to the invention, the slidable head provides a transfer valve controlled by at least a spring.

Still according to the invention, the actuation means for the slidable head provide a transmission from the output shaft to the rotation shaft of the slidable head.

Furthermore, according to the invention, above the slidable head, and an opening is provided for admission of fresh air or fresh air-fuel mixture, a rotating disc being provided on the rotation shaft of the slidable head. A second opening is provided on the rotating disc. The second opening interfering with the first opening, for admission of fresh air or fresh air-fuel mixture in correspondence of the stroke of the slidable head between the top dead centre and the exhaust port closure point.

According to the present invention, the slidable head can be actuated by a mechanical system, by a hydraulic or pneumatic system, or by an electro-magnetic coil.

Still according to the present invention, the slidable head can be moved by the action of a spring.

Furthermore, according to the present invention, a spark plug can be mounted on the engine head, or it can be mounted on the slidable head.

Further, according to the present invention, the transfer valve of the slidable head can be a reed head, or another type of head determining the inner shape of the slidable head, as well as the dimensions of the same.

According to present the invention, the upper surface of the piston can be provided with a seat complementary with the shape of said slidable head.

The engine according to the present invention is supplied with gasoline or diesel fuel.

Further, it may have a carburettor, for direct injection of the fuel.

It is also possible, according to the invention, to provide a means for reducing the effects of the burst on the slidable head.

According to the invention, the head may be actuated by electric coil, compressed air or hydraulic mechanisms.

The present invention may have the following advantages:

- optimised discharge cycles of the burst gases and suction—charging of the fresh air within the cylinder;
- contemporaneous and separated exchange of (burst and fresh) gases within the cylinder, particularly important for two-stroke engines, presently suffering or lacking efficient scavenging of the cylinder a complete charging with fresh air;
- controlled gas combustion and expansion of the slidable head;
- completely avoids the need of classic valves as well as the relevant control and movement systems;
- engine having the features of four-stroke engines with the advantage that, while traditional four-stroke engines the whole cycle requires two revolutions of the output shaft, engine according to the invention makes the whole cycle with a single revolution of the output shaft, as in the traditional two-stroke engines;

transfer paths for air/gasoline mixture from engine carter to the cylinder are eliminated;

it is exploited the typical lubrication of the four-stroke engines;

the oil/fuel mixture is not used, thus obtaining remarkable environmental advantages;

all the drawbacks of the traditional two-stroke engines are prevented, at the same time maintaining their advantages;

constructive advantages are obtained, with particular reference to the engine head.

BRIEF DESCRIPTION OF THE DRAWINGS

The present invention will be now described, for illustrative but not limitative purposes, according to its preferred embodiments, with particular reference to the figures of the enclosed drawings, wherein.

DETAILED DESCRIPTION OF THE INVENTION

Figure 4:
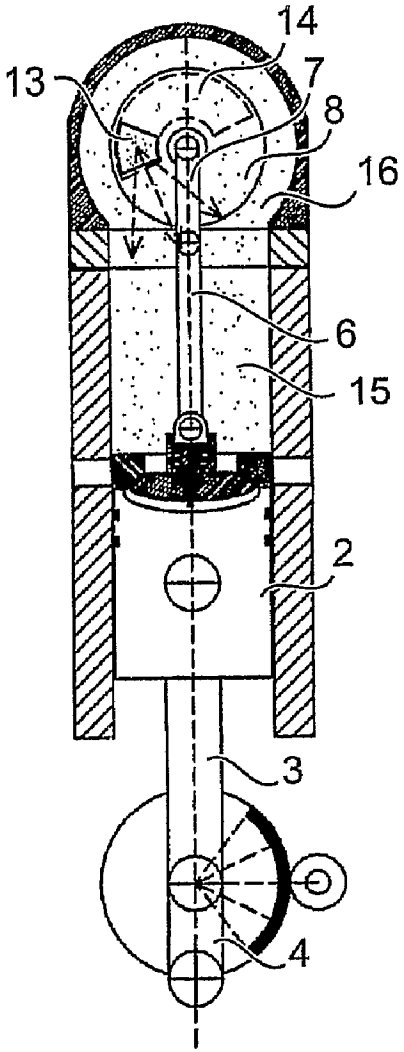
FIG. 4 is a section view of the engine of FIG. 1 in a fourth operative position.

As shown in FIGS. 1-9 of the enclosed drawings, it is shown a first embodiment of an engine according to the invention, comprising a cylinder 1, a piston 2, a connecting rod 3 and crank 4 system for movement of piston 2, and a slidable head, generically indicated by reference number 5, and that will be described in greater detail in the following. Also shown are a connecting rod 6 and crank 6 system for movement of the slidable head, an air and/or fuel suction system, generically indicated by reference number 8, and that will be described in greater detail in the following, as well as a system for transferring the motion (see particularly FIGS. 8 and 9) of the connecting rod 6 and crank 6 system for movement of the slidable head 5, the system for transferring the motion being generically indicated by reference number 10, and being described in greater detail in the following.

As it can be seen from the figures, an engine according to the present invention is realised providing, a disc-shaped cylindrical body 5 inside the cylinder 1 of the standard two-stroke engine, with an air transfer valve 9, having a large diameter and actuated by a spring 10.

Slidable head 5 with the valve 9 is the multi-functional mechanism to carry out scavenging of the cylinder, so as to eject the burst gases by the exhaust ports 11, and at the same time carrying out intake of fresh air inside the cylinder 1.

The operation cycle of the engine shown in FIGS. 1-9 of the enclosed drawings may be described as follows.

Figure 1:
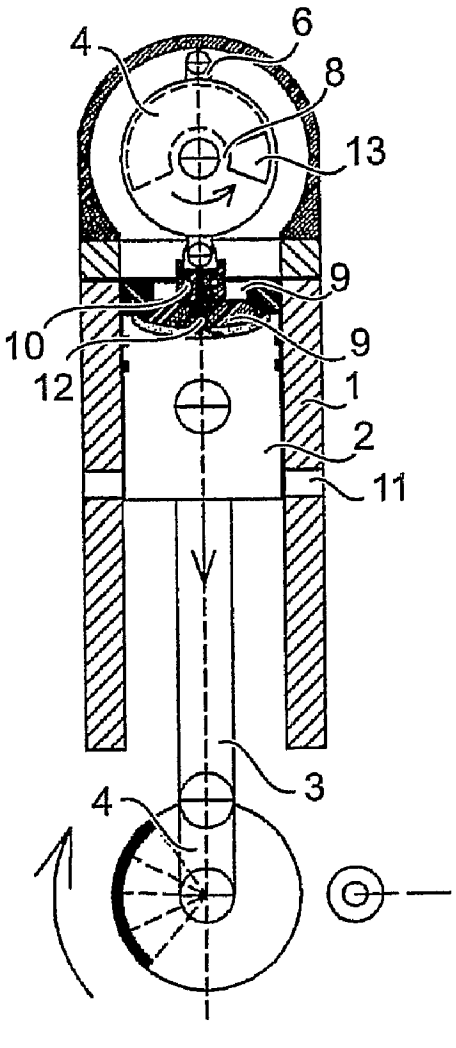
FIG. 1 is a section view of a first embodiment of an engine according to the invention in a first operative position.

FIG. 1, shows a piston 2 correspondes with its top dead centre (T.D.C.), where the burst occurs by the spark plug 12. The ignition of mixture can be obtained by every other system, as well as the fuel being suctioned mixed with fresh air, or injected separately, e.g. by electronic injection.

As it can also be noted from the figures, that a rotating disc 8 is provided above the slidable head 5, having an opening 13 for admission of air or air-fuel mixture. The opening interacting with an opening 14, is shown in dashed line in FIGS. 1-7, and can be seen in FIGS. 8 and 9.

In the position of FIG. 1, opening 13 is not interfering with opening 14, so that fresh air is not introduced.

The expansion step occurs after the burst (FIG. 2), so that piston 2 reaches the position close to the covering of the scavenging 11 realised on the cylinder.

Figure 3:
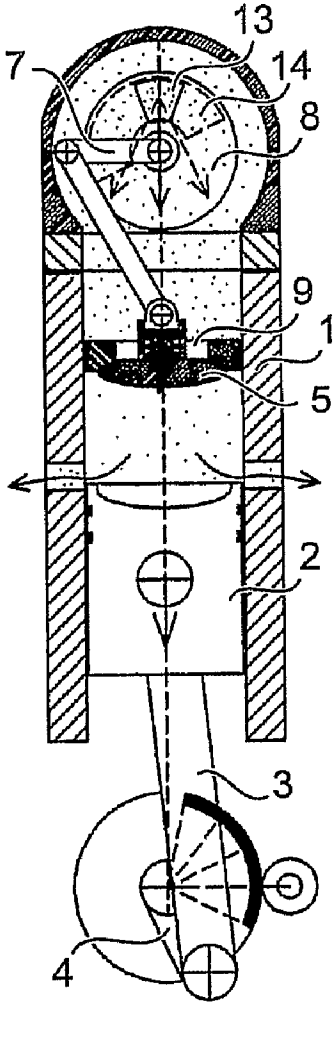
FIG. 3 is a section view of the engine of FIG. 1 in a third operative position.

Piston 2, as shown in FIGS. 3 and 4, continues its stroke downward, opening the exhaust ports 11 for ejection of burst gases. Now, the downward movement of the slidable head 5 begins, by the transfer of the motion from the connecting rod 3 and crank 4 system for movement of piston 2 to the slidable head 5, and that will be described in greater detail in the following.

The slidable head 5 runs all along the volume of the cylinder chamber 15 while the piston 2 covers the space of the ports 11.

In this way a full scavenging of the chamber 15 is obtained, thus ejecting all the gases contained therein.

At the same time, opening 13 covers the whole extension of the opening 14 admitting air or air and fuel within the chamber 16, and consequently also inside the chamber 15 during its emptying.

Once reached, the bottom dead centre (B.D.C.), ascent of piston 2 and slidable head 5 upward starts again.

While piston 2 fully covers exhaust ports 11, head 5 reaches its top dead centre, thus determining the transfer of fresh air from chamber 16 to the chamber 15 through the transfer valve 10. In fact, within chamber 16 this phase is closed outward since openings 13 and 14 do not interfere each other, compression occurs determining the opening the transfer valve 10, against the force of spring 9, until closing the valve 10 in the position shown in FIG. 6.

Figure 7:
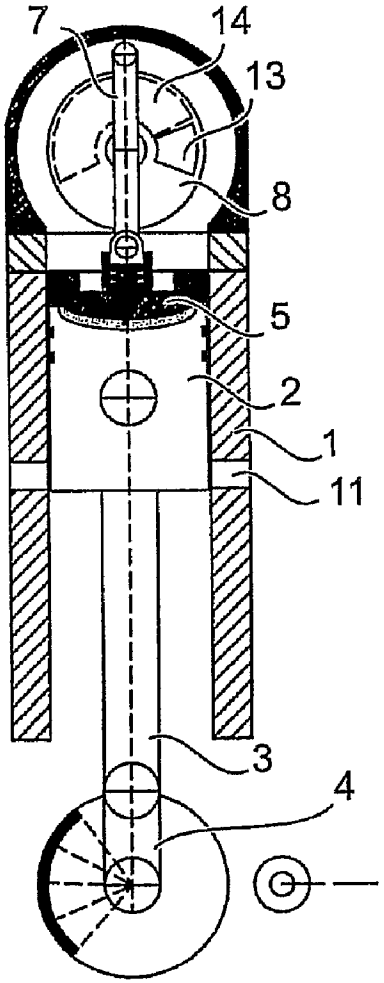
FIG. 7 is a section view of the engine of FIG. 1 in a seventh operative position.
Figure 6:
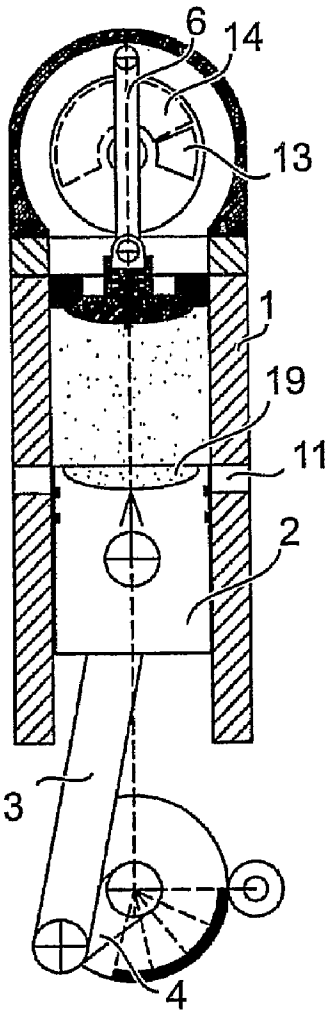
FIG. 6 is a section view of the engine of FIG. 1 in a sixth operative position.
Figure 5:
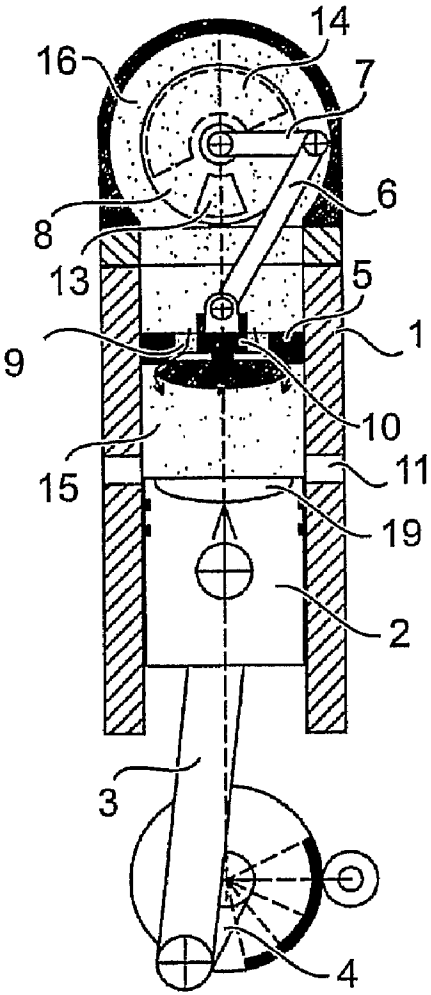
FIG. 5 is a section view of the engine of FIG. 1 in a fifth operative position.
Figure 9:
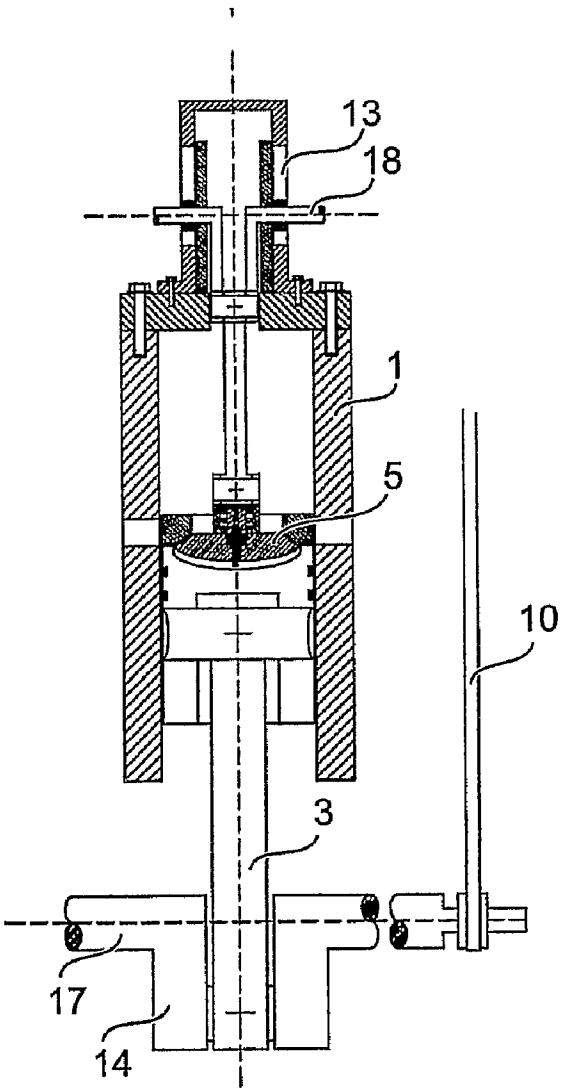
FIG. 9 is a section view of the engine of the previous figures, similar to FIG. 8, in a different operative position.
Figure 8:
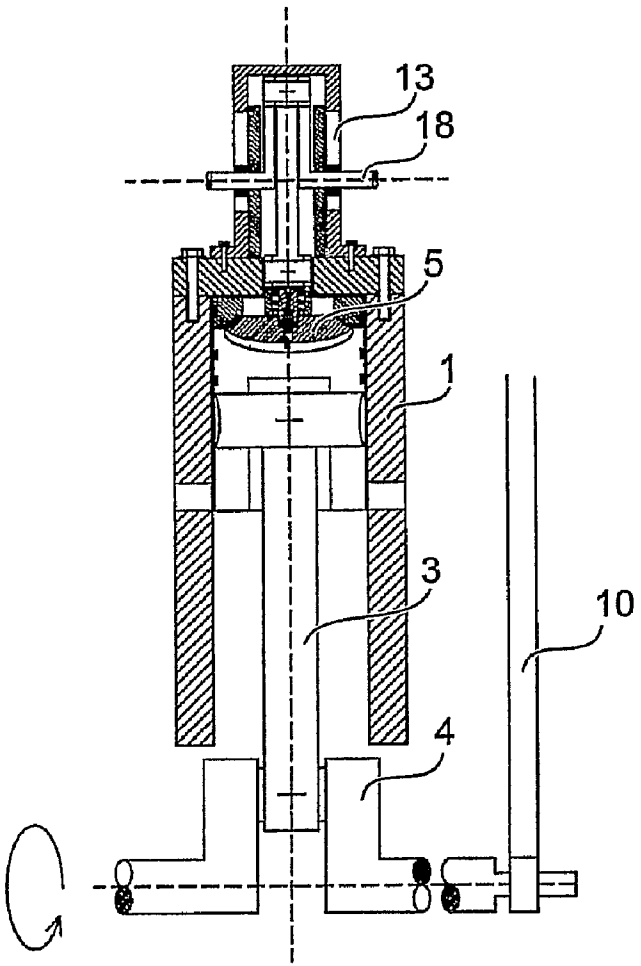
FIG. 8 is a section view of the engine of the previous figures in a further operative position.

In this position, piston 2 has closed exhaust ports 11, and the compression phase begins, until reaching the position of FIG. 7.

Figure 2:
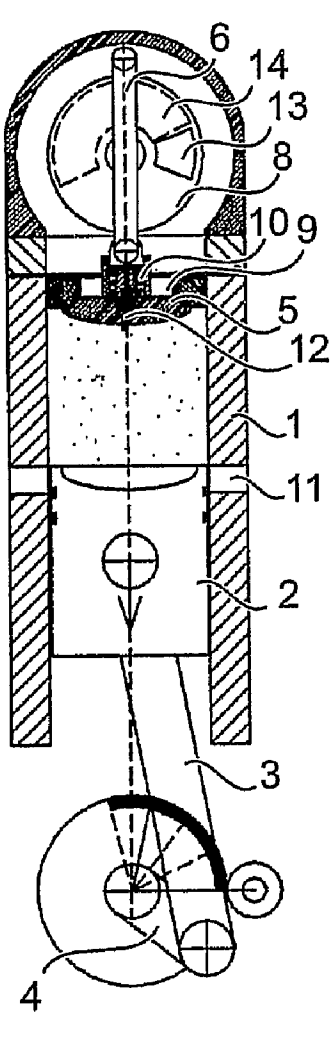
FIG. 2 is a section view of the engine of FIG. 1 in a second operative position.

Thus, in the engine, the cylinder scavenging and fresh air admission phase occurs when the slidable head 5 moves toward the B.D.C. (FIGS. 2 and 3).

During the ascent phase of the slidable head 5 toward B.D.C., transfer valve 10 is always open, thus allowing the passage of the intake air from the upper part 16 to the lower part 15, i.e. between the head 5 and the piston 2.

The system is realised in such a way that the movement of the slidable head 5 from its T.D.C. toward is B.D.C. begins exactly when the piston is beginning the opening of the exhaust ports 11, and ending when piston 2 is at its B.D.C. (FIG. 4).

When it is in this position, slidable head 5 has made a full stroke and is in correspondence of its B.D.C.

While the upward motion of piston 2 begins, and until the closing of the exhaust ports 11, slidable head 5 makes its upward stroke toward its T.D.C.

Movement of slidable head 5 is obtained by a transmission mechanism, generically indicated by reference number 10, that coupled with the output shaft 17, transmits the rotation to the axis 18 of the slidable head 5.

Transmission of rotation occurs in correspondence of a set arc of the output shaft 18 revolution, and particularly in correspondence of an arc of about 104°, corresponding to the arc between the point when the exhaust ports begins opening and the point when the exhaust ports 11 close (piston 2, during the rotation of the output shaft 18 along this arc opens exhaust ports 11 and, passing through its B.D.C., begins its stroke toward its T.D.C. until closing the exhaust ports 11).

As it can be noted, upper part 19 of piston 2 is shaped complementary with the slidable head 5.

Figure 10:
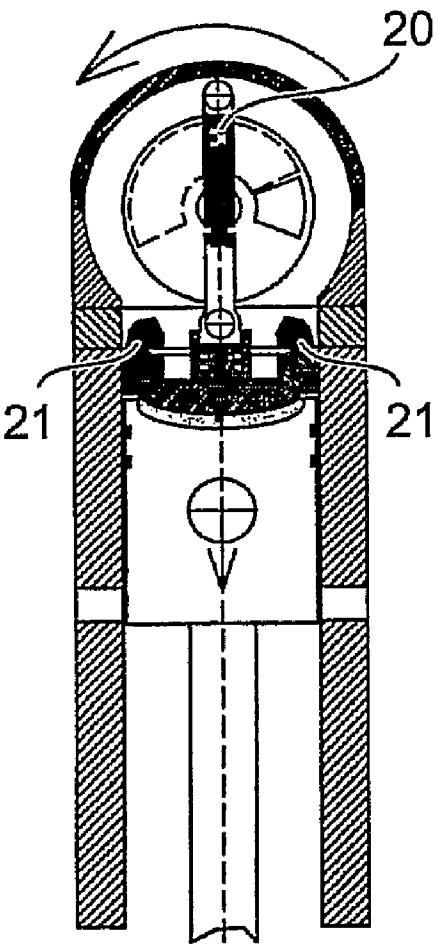
FIG. 10 is a section view of a second embodiment of an engine according to the invention in a first operative position.
Figure 11:
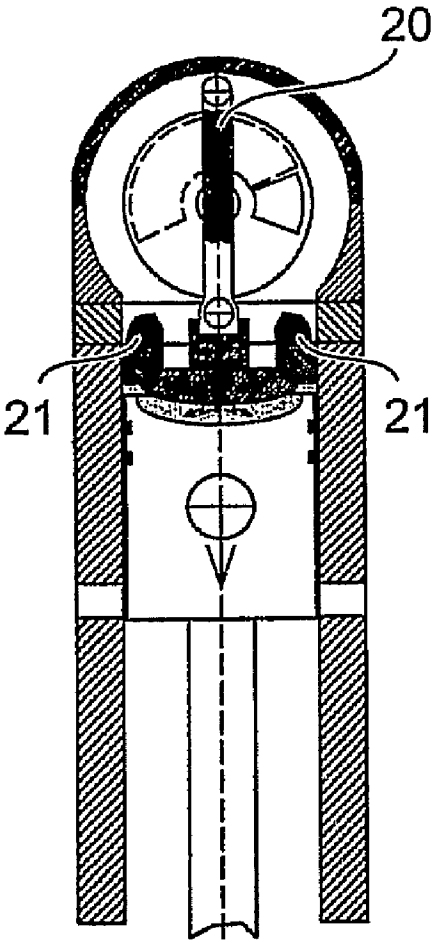
FIG. 11 is a section view of a second embodiment of an engine according to the invention in a second operative position.
Figure 12:
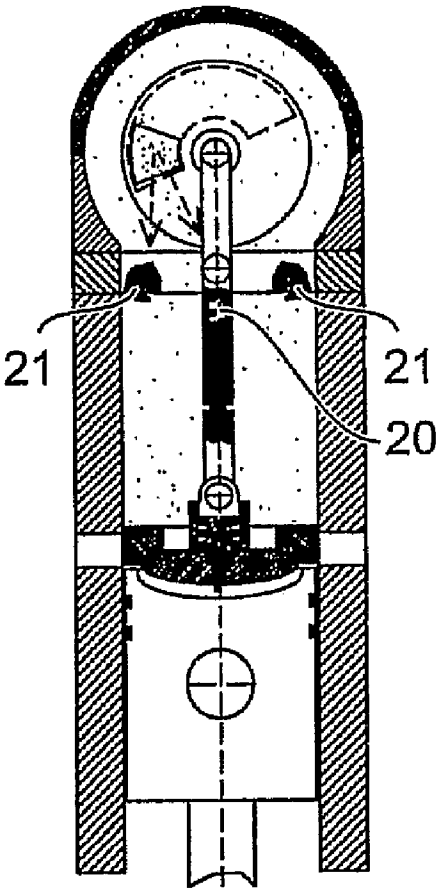
FIG. 12 is a section view of a second embodiment of an engine according to the invention in a third operative position.

As shown in FIGS. 10, 11 and 12, wherein the same reference numbers are used to indicate parts corresponding with those of the previous embodiment, a spring 20 is provided, telescopically mounted within the connecting rod 6 of the mechanism for moving the slidable head 5, and dampening the burst induced shock, thus reducing the pressure on the connecting rod of the transfer valve 10.

Springs 21 have been provided for obtaining the same result, as with the above slidable head 5 (the preferable number of the springs is not indicated).

Figure 14:
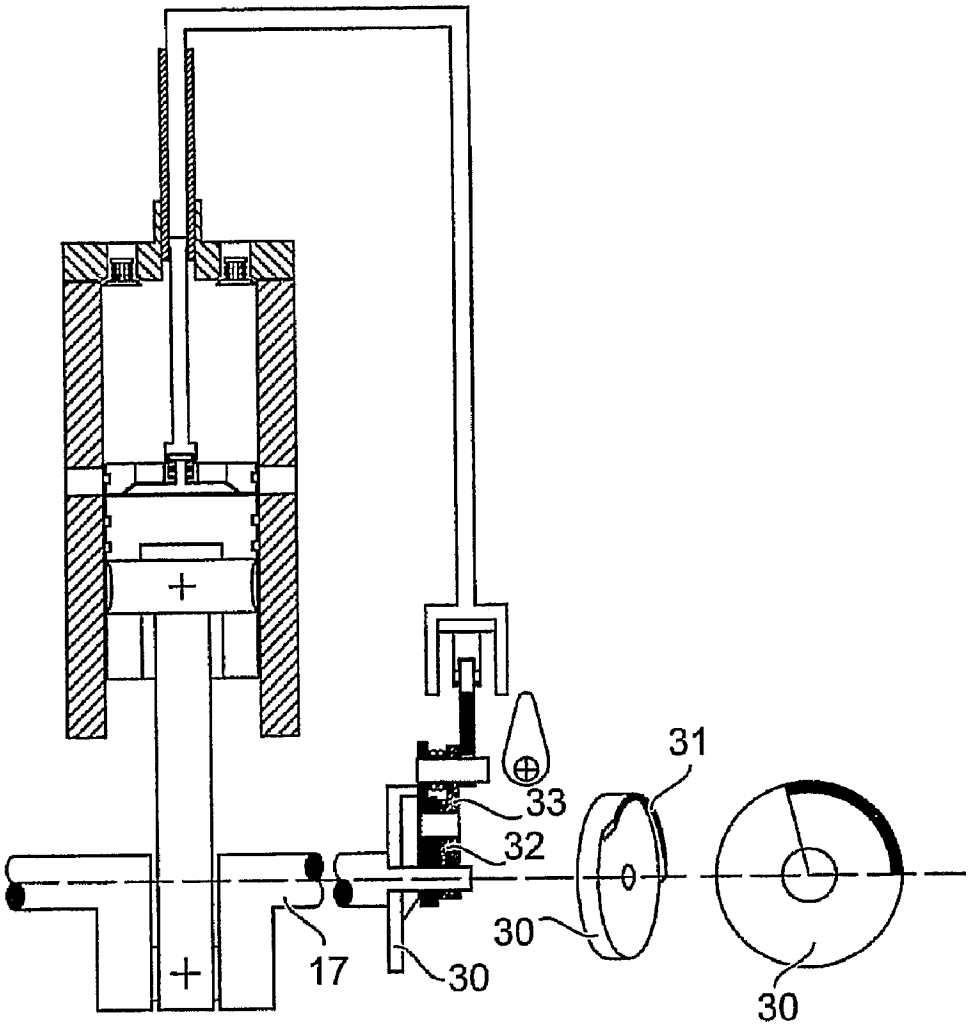
FIG. 14 is a section view of a third embodiment of an engine according to the invention in a second operative position.
Figure 13:
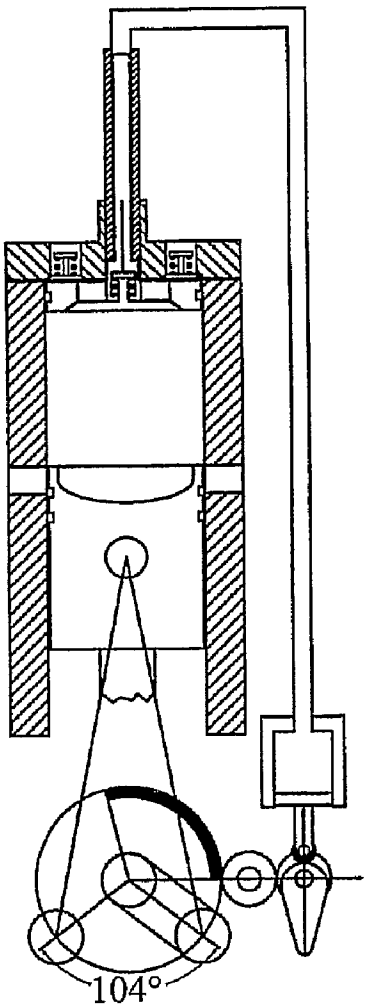
FIG. 13 is a section view of a third embodiment of an engine according to the invention in a first operative position.

In FIGS. 13 and 14, wherein the same reference numbers are used to indicate parts corresponding with those of the previous embodiment, it is provided a different realisation of the system 10 for transferring the motion from the connecting rod 3 and crank 4 system for the movement of the piston 2 to the slidable head 5.

Said system 10 provides a disc 30, with a raised arc 31, of about 104° of the arc of the output shaft 17, so as to interfere with a toothed wheel 32 of hydraulic pump 33. Once the hydraulic pump has been actuated, it causes oil pressure sufficient to actuate the motion of the slidable head 5.

Figure 17:
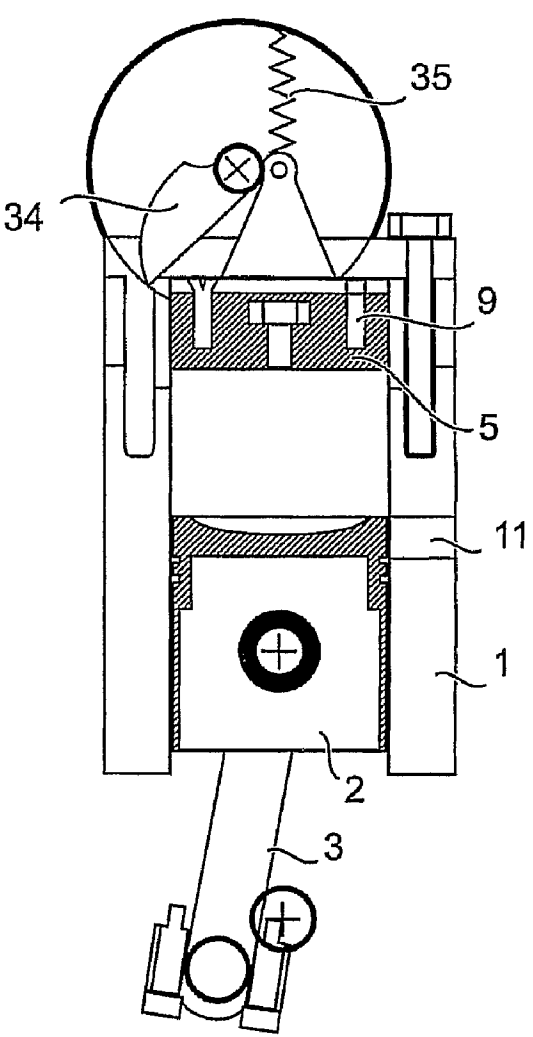
FIG. 17 is a section view of a fourth embodiment of an engine according to the invention in a third operative position.
Figure 16:
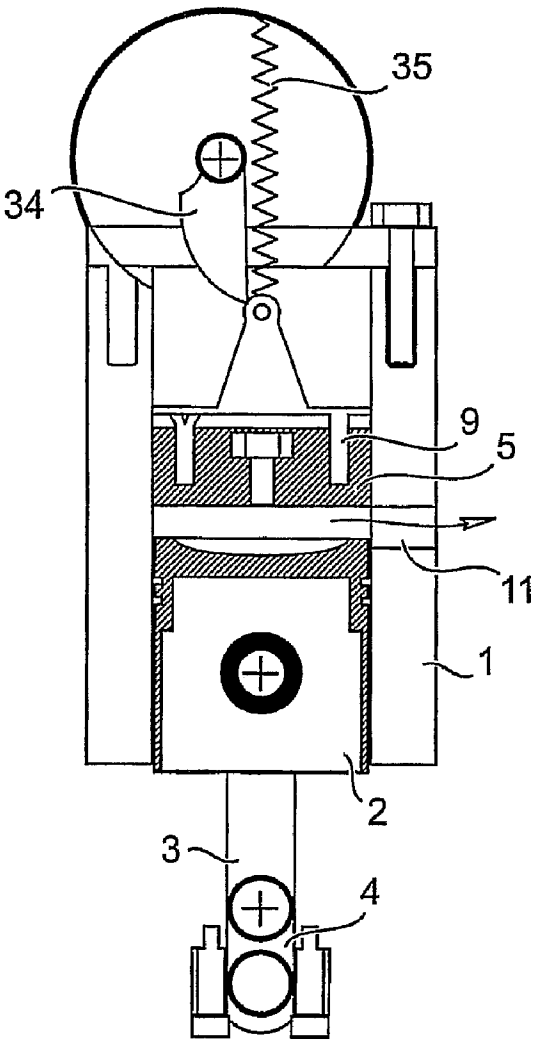
FIG. 16 is a section view of a fourth embodiment of an engine according to the invention in a second operative position.
Figure 15:
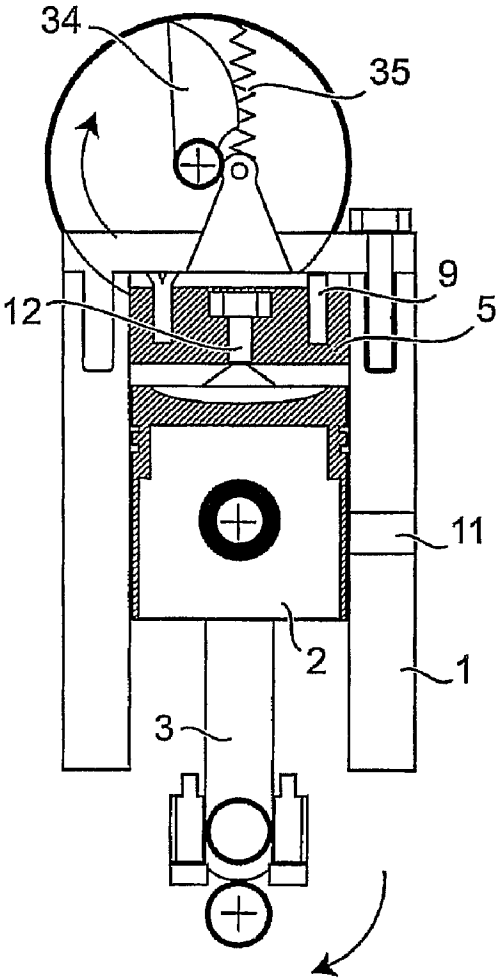
FIG. 15 is a section view of a fourth embodiment of an engine according to the invention in a first operative position.

Coming now to observe FIGS. 15-17, wherein the same reference numbers are used to indicate parts corresponding with those of the previous embodiment, a different realisation of the actuating system of the slidable head 5 is provided.

In this case a crankshaft 34 is connected to the output shaft 18 by a toothed belt (not shown), with a transmission ratio 1:1.

Cam 34 is realised with a particular thrusting curve, in such a way to have a delayed effect on the slidable head 5, notwithstanding it is rotating.

The straight part of the cam allows the quick ascent of the head 5, by the action of spring 35, so that, when piston 2 closes the exhaust ports 11, head 5 is at the Upper Dead Centre, having already completed the transfer of fresh mixture through valve 9.

Therefore, head 5 makes its whole stroke while piston 2 opens and closes exhaust ports 11.

Furthermore, head 5 can be actuated by an electric coil, by compressed air or by hydraulic mechanisms (not shown in the figures), the same technical teachings of the previous embodiments remaining valid.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. A two-stroke internal combustion engine supplied with gasoline, diesel, fuel, or other conventional fuel comprising a piston-cylinder assembly, said cylinder providing exhaust ports, said piston-cylinder assembly providing a head slidable within said cylinder between the Top Dead Centre of the piston stroke and a closure position of the exhaust ports, said slidable head providing a transfer valve for fresh air or fresh air-fuel mixture within the compression and burst chamber of the piston-cylinder assembly, sliding of said slidable head inside the cylinder being controlled by actuation means coordinated with the piston actuation system, upward said slidable head a fresh air or fresh air-fuel mixture system being provided for suction during the stroke of said slidable head between the Top Dead Centre and the exhaust port closure point, said actuation means of the slidable head provide a crankshaft connected with the output shaft by a toothed belt, with a 1:1 transmission ratio, said cam having a particular thrusting curve, to act with delay on the slidable head notwithstanding it is rotating, said cam having a straight part allowing ascent of the head, by the action of springs, in a much quicker way, so that, when the piston closes the exhaust ports, head is at the Top Dead Centre, having already carried out the transfer action of the fresh mixture through the transfer valve.

2. An internal combustion engine according to claim 1, wherein said slidable head provides a transfer valve controlled by at least a spring.

3. An internal combustion engine according to claim 1, wherein said actuation means for the slidable head provide a transmission from the output shaft to the rotation shaft of the slidable head.

4. An internal combustion engine according to claim 1, wherein above said slidable head an opening is provided for admission of fresh air or fresh air-fuel mixture, a rotating disc being provided on said rotation shaft of the slidable head, a second opening being provided on said rotating disc said second opening interfering with said first opening, for admission of fresh air or fresh air-fuel mixture in correspondence of the stroke of said slidable head between the Top Dead Centre and the exhaust port closure point.

5. An internal combustion engine according to claim 1, wherein said slidable head is actuated by a mechanical system, by a hydraulic or pneumatic system, or by an electromagnetic coil.

6. An internal combustion engine according to claim 1, wherein said slidable head is moved by the action of a spring.

7. An internal combustion engine according to claim 1, wherein the spark plug is mounted on the engine head.

8. An internal combustion engine according to claim 1, wherein the spark plug is mounted on the slidable head.

9. An internal combustion engine according to claim 1, wherein the transfer valve of the slidable head is a reed head, or another type of head determining the inner shape of the slidable head, as well as the dimensions of said slidable head.

10. An internal combustion engine according to claim 1, wherein the upper surface of the piston is provided with a seat complementary with the shape of said slidable head.

11. An internal combustion engine according to claim 1, wherein it is supplied with gasoline or diesel fuel.

12. An internal combustion engine according to claim 1, wherein it is provided a standard supply of the fuel, with carburetor.

13. An internal combustion engine according to claim 1, wherein fuel is supplied by direct injection.

14. An internal combustion engine according to claim 1, wherein means are provided for reducing the effects of the burst on the slidable head.

15. An internal combustion engine according to claim 1, wherein said head is actuated by electric coil, compressed air or hydraulic mechanisms.

* * * * *

UNITED STATES PATENT AND TRADEMARK OFFICE

CERTIFICATE OF CORRECTION

PATENT NO. : 7,503,290 B2
APPLICATION NO. : 11/762964
DATED : March 17, 2009
INVENTOR(S) : Ivan Skulic It is certified that error appears in the above-identified patent and that said Letters Patent is hereby corrected as shown below:

Title Page;

In the Masthead:

Should read;

(75) Inventor: Ivan Skulic, Lupoglav (HR)

Should read;

(73) Assignees: Ivan Skulic, Lupoglav (HR);
Bruno Abenavoli, Naples (IT)

Foreign Application Priority Data; Please insert

-- (30) Dec. 29, 2004 (IT) ..... RM2004A000643 --

Signed and Sealed this

Seventh Day of July, 2009

John Doll

JOHN DOLL
*Acting Director of the United States Patent and Trademark Office*